US009305415B2

(12) United States Patent
Fu et al.

(10) Patent No.: US 9,305,415 B2
(45) Date of Patent: Apr. 5, 2016

(54) PAPER SHEET MANAGEMENT SYSTEM, PAPER SHEET MANGEMENT APPARATUS, PAPER SHEET MANAGEMENT METHOD, AND PAPER SHEET MANAGEMENT PROGRAM

(75) Inventors: Gui Fu, Tokyo-To (JP); Hajime Morino, Kasukabe (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 266 days.

(21) Appl. No.: 12/998,132

(22) PCT Filed: Sep. 22, 2008

(86) PCT No.: PCT/JP2008/067132

§ 371 (c)(1), (2), (4) Date: Mar. 21, 2011

(87) PCT Pub. No.: WO2010/032336

PCT Pub. Date: Mar. 25, 2010

(65) Prior Publication Data

US 2011/0172808 A1 Jul. 14, 2011

(51) Int. Cl.
*G07D 11/00* (2006.01)
*G07D 7/20* (2006.01)

(52) U.S. Cl.
CPC ..... *G07D 11/0066* (2013.01); *G07D 11/0072* (2013.01); *G07D 11/0084* (2013.01); *G07D 7/20* (2013.01); *G07D 11/0033* (2013.01)

(58) Field of Classification Search
CPC ..... G07D 11/0033; G07D 11/0066; G07D 11/0072; G07D 11/0084; G07D 7/20
See application file for complete search history.

(56) References Cited

U.S. PATENT DOCUMENTS 6,504,946 B1 * 1/2003 Rossignoli ..... 382/139
6,863,214 B2 * 3/2005 Garner et al. ..... 235/379

(Continued)

FOREIGN PATENT DOCUMENTS

EP 1 396 821 Al 3/2004
EP 1 445 740 A2 8/2004

(Continued)

OTHER PUBLICATIONS

Machine translation of JP 2008-015813.*

(Continued)

*Primary Examiner* — Katrina Fujita
(74) *Attorney, Agent, or Firm* — Renner, Kenner, Greive, Bobak, Taylor & Weber

(57) ABSTRACT

A banknote management system 1 includes a banknote handling apparatus 2 having stackers for stacking banknotes, the banknote handling apparatus sorting the banknotes based on sorting conditions set for the respective stackers, and sequentially stacking the sorted banknotes in the stackers corresponding to the sorting conditions; and a banknote management apparatus 3 managing the banknote handling apparatus. The system includes a DB registration specifying unit 32B specifying a stacker 11 a DB registration necessity of which is specified among the stackers; a banknote detailed information creating unit 37B creating banknote detailed information for recognizing a banknote that is stacked in the stacker a DB registration of which is set to be necessary; and a DB control unit 37D registering the banknote detailed information in a database 33. The system can minimize a memory capacity of the database and a volume of banknote detailed information to be registered in the database.

11 Claims, 8 Drawing Sheets

(56) References Cited

U.S. PATENT DOCUMENTS

| | | | | |
|---|---|---|---|---|
| 8,634,632 | B2 * | 1/2014 | Numata | G07D 7/0006 382/138 |
| 2002/0184151 | A1 | 12/2002 | Maloney | |
| 2004/0062430 | A1 | 4/2004 | Buntscheck | |
| 2005/0139671 | A1 * | 6/2005 | McGlamery et al. | 235/449 |
| 2007/0267496 | A1 * | 11/2007 | Franklin | 235/449 |
| 2008/0237332 | A1 * | 10/2008 | Suwa | 235/375 |
| 2010/0010663 | A1 * | 1/2010 | Nakamura | G07D 11/0039 700/223 |

FOREIGN PATENT DOCUMENTS

| | | | |
|---|---|---|---|
| EP | 1 975 887 A2 | 10/2008 | |
| JP | 2001-216551 | 8/2001 | G07D 7/00 |
| JP | 2004-054613 | 2/2004 | G07D 9/00 |
| JP | 2007/213148 | 8/2007 | G07D 7/20 |
| JP | 2008-015813 | 1/2008 | G07D 7/00 |
| WO | WO 2008/044277 | 4/2008 | G07D 11/00 |

OTHER PUBLICATIONS

Machine translation of JP 2001-216551.*

Machine translation of JP 2004-054613.*

Machine translation of JP 2007-213148.*

European Search Report (Application No. 08876991.4—PCT/JP2008/067132) (6 pages—dated Sep. 2, 2012).

First Office Action (Chinese Patent Application No. 200880131206.0 dated Mar. 12, 2012—8 pages with English Translation 11 pages).

* cited by examiner

36

| STACKER / SET MODE | FIRST STACKER | | SECOND STACKER | | THIRD STACKER | | FOURTH STACKER | |
|---|---|---|---|---|---|---|---|---|
| TELLER DEPOSIT MODE | ○ | 10,000-YEN BANKNOTE | ○ | 5,000-YEN BANKNOTE | ○ | 2,000-YEN BANKNOTE | ○ | 1,000-YEN BANKNOTE |
| TELLER DISPENSE MODE | ○ | 10,000-YEN BANKNOTE | ○ | 5,000-YEN BANKNOTE | ○ | 2,000-YEN BANKNOTE | ○ | 1,000-YEN BANKNOTE |
| ATM LOADING MODE "1" | ○ | ATM FIT (ATM FIT NOTE) | ○ | TELLER FIT (NORMAL FIT NOTE) | ○ | UNFIT (UNFIT NOTE) | × | OTHERS |
| ATM LOADING MODE "2" | ○ | UNFIT (UNFIT NOTE) | ○ | ATM FIT (ATM FIT NOTE) | ○ | TELLER FIT (NORMAL FIT NOTE) | × | OTHERS |
| ACCOUNT MODE "1" | ○ | 10,000-YEN BANKNOTE UNFIT | ○ | 5,000-YEN BANKNOTE UNFIT | ○ | 2,000-YEN BANKNOTE UNFIT | ○ | 1,000-YEN BANKNOTE UNFIT |
| ACCOUNT MODE "2" | ○ | 10,000-YEN BANKNOTE UNFIT | × | 5,000-YEN BANKNOTE UNFIT | × | 2,000-YEN BANKNOTE UNFIT | ○ | 1,000-YEN BANKNOTE UNFIT |
| ⋮ | | ⋮ | | ⋮ | | ⋮ | | ⋮ |

FIG. 3

PAPER SHEET MANAGEMENT SYSTEM, PAPER SHEET MANGEMENT APPARATUS, PAPER SHEET MANAGEMENT METHOD, AND PAPER SHEET MANAGEMENT PROGRAM

FIELD OF THE INVENTION

The present invention relates to, for example: a paper sheet management system which includes a paper sheet handling apparatus having a plurality of stacking units, the paper sheet handling apparatus being configured to sort paper sheets and to stack the paper sheets in the respective stacking units, and a paper sheet management apparatus configured to store, in a database, paper sheet detailed information of the paper sheets sorted and stacked by the paper sheet handling apparatus; the paper sheet management apparatus; a paper sheet management method; and a paper sheet management program.

BACKGROUND ART

As an apparatus for counting the number of paper sheets, such as banknotes, checks, bills, gift coupons and so on, while sorting the paper sheets depending on sorting conditions such as types or the like, a paper sheet handling apparatus has been conventionally known (see, e.g., Patent Document 1).

The paper sheet handling apparatus has a plurality of stacking units, i.e., stackers for staking paper sheets for each preset sorting condition. The paper sheet handling apparatus is configured to sort and stack paper sheets depending on the sorting conditions, and to count the number of paper sheets stacked in the respective stackers.

Namely, when paper sheets to be handled are Japanese banknotes, for example, the paper sheet handling apparatus has a first stacker for 10,000-yen banknote, a second stacker for 5,000-yen banknote, a third stacker for 2,000-yen banknote and a fourth stacker for 1,000-yen banknote. In this case, even when Japanese banknotes of plurality of denominations are put into the paper sheet handling apparatus, the banknotes are sorted such that a 10,000-yen banknote is stacked in the first stacker, a 5,000-yen banknote is stacked in the second stacker, a 2,000-yen banknote is stacked in the third stacker, and a 1,000-yen banknote is stacked in the fourth stacker.

In recent years, there has been known a paper sheet management system including a paper sheet handling apparatus and a paper sheet management apparatus, such as a personal computer, connected to the paper sheet handling apparatus so as to manage the paper sheet handling apparatus (see, Patent Documents 2, 3 and 4, for example).

The paper sheet management apparatus is configured to store, in a database, banknote detailed information of respective banknotes having been put into the paper sheet handling apparatus, such as a denomination result for recognizing denominations of the banknotes, a fitness result for recognizing fit notes and unfit notes, and transaction data, in a manner where each banknote detailed information is related to each other. The transaction data include, for example, a transaction start date and time of banknotes put into the paper sheet handling apparatus, and a user ID for recognizing a person who has deposited or dispensed the banknotes.

In such a paper sheet management system, the paper sheet management apparatus stores, in a database, the banknote detailed information about the respective banknotes having been put into the paper sheet handling apparatus, and the paper sheet management apparatus searches the banknote detailed information registered in the database depending on a search condition. Thus, a user can easily search the banknote detailed information registered in the database.

Patent Document 1: JP2008-46870A
Patent Document 2: JP2004-310594A
Patent Document 3: U.S. Pat. No. 7,201,320 B
Patent Document 4: U.S. Pat. No. 7,040,476 B

DISCLOSURE OF THE INVENTION

In the aforementioned conventional paper sheet management system, paper sheet detailed information about paper sheets having been put into the paper sheet handling apparatus is sequentially obtained, and all the paper sheet detailed information sequentially obtained is unconditionally registered in the database. However, since unnecessary paper sheet detailed information is also registered in the database, it is necessary to secure an extremely large capacity as a memory capacity of the database.

In addition, in the conventional paper sheet management system, since an extremely large volume of data of the paper sheet detailed information is registered in the database, when desired paper sheet information is searched from the enormous data, a larger search load is imposed.

In addition, in foreign countries, a considerably large number of counterfeit notes circulate in markets recently, and such a counterfeit note is often put into the paper sheet handling apparatus. Thus, there is increasing demand for storing, in the database, paper sheet detailed information including a paper sheet image.

However, when a paper sheet image is included in the paper sheet detailed information, it is necessary to secure a database having a still larger memory capacity. Moreover, there is a problem in that, when desired paper sheet detailed information is searched from the database, a still larger search load is imposed.

Thus, the present invention has been made in view of the above circumstances. The object of the present invention is to provide a paper sheet management system, a paper sheet management apparatus, a paper sheet management method, and a paper sheet management program, which are capable of minimizing a memory capacity of a storage unit and a volume of paper sheet detailed information to be registered in the storage unit, by avoiding registration of unnecessary paper sheet detailed information in the storage unit, so as to remarkably reduce a load on the storage unit which is required for searching the paper sheet detailed information.

Means for Solving the Problem

In order to achieve the above object, the paper sheet management system recited in claim 1 is a paper sheet management system including: a paper sheet handling apparatus having a plurality of stacking units for stacking paper sheets, the paper sheet handling apparatus being configured to sort the paper sheets based on sorting conditions for sorting the paper sheets, the sorting conditions being set for the respective stacking units, and to sequentially stack the sorted paper sheets in the stacking units corresponding to the sorting conditions; and a paper sheet management apparatus configured to manage the paper sheet handling apparatus; the paper sheet management system including: a registration subject specifying unit configured to specify a stacking unit as a registration subject among the plurality of stacking units; a paper sheet detailed information obtaining unit configured to obtain paper sheet detailed information of a paper sheet that is stacked in the stacking unit specified as a registration subject by the registration subject specifying unit; and a registration control unit configured to register, in a storage unit the paper sheet detailed information obtained by the paper sheet detailed information obtaining unit.

In addition, in the paper sheet management system recited in claim 2 according to claim 1, the paper sheet management system includes a sorting condition setting unit configured to set the sorting conditions for sorting the paper sheets, for the respective stacking units.

In addition, in the paper sheet management system recited in claim 3 according to claim 2, the registration control unit is configured to manage the paper sheet detailed information registered in the storage unit for each sorting condition corresponding to the stacking unit as a registration subject.

In addition, in the paper sheet management system recited in claim 4 according to any one of claims 1 to 3, the paper sheet management system includes a recognition information identifying unit configured to identify recognition information that uniquely specifies one of the paper sheets, wherein the registration control unit is configured to include recognition information of the paper sheet, which is identified by the recognition information identifying unit, in the paper sheet detailed information, and to register the paper sheet detailed information including the recognition information in the storage unit.

In addition, in the paper sheet management system recited in claim 5 according to any one of claims 1 to 3, the paper sheet management system includes an image obtaining unit configured to obtain a paper sheet image of the paper sheet, wherein the registration control unit is configured to include a paper sheet image of the paper sheet, which is obtained by the image obtaining unit, in the paper sheet detailed information, and to register the paper sheet detailed information including the paper sheet image in the storage unit.

In addition, in the paper sheet management system recited in claim 6 according to any one of claims 1 to 3, the paper sheet management system includes a type recognition unit configured to recognize a type of the paper sheet, wherein the registration control unit is configured to include a recognition result of the type recognition unit relating to the paper sheet in the paper sheet detailed information, and to register the paper sheet detailed information including the recognition result in the storage unit.

In addition, in the paper sheet management system recited in claim 7 according to any one of claims 1 to 3, the paper sheet management system includes a fitness recognition unit configured to recognize whether the paper sheet is an unfit note or a fit note, wherein the registration control unit is configured to include a recognition result of the fitness recognition unit relating to the paper sheet in the paper sheet detailed information, and to register the paper sheet detailed information including the recognition result in the storage unit.

In addition, in order to achieve the above object, a paper sheet management system recited in claim 8 is a paper sheet management system including: a paper sheet handling apparatus having a plurality of stacking units for stacking paper sheets, the paper sheet handling apparatus being configured to sort the paper sheets based on sorting conditions for sorting the paper sheets, the sorting conditions being set for the respective stacking units, and to sequentially stack the sorted paper sheets in the stacking units corresponding to the sorting conditions; and a paper sheet management apparatus configured to manage the paper sheet handling apparatus; the paper sheet management system including: a registration subject specifying unit configured to specify a stacking unit as a registration subject among the plurality of stacking units; a paper sheet detailed information obtaining unit configured to obtain paper sheet detailed information of paper sheets stacked in the stacking units; and a registration control unit configured to register, in a storage unit, paper sheet detailed information of a paper sheet that is stacked in the stacking unit specified as a registration subject by the registration subject specifying unit, among the paper sheet detailed information obtained by the paper sheet detailed information obtaining unit.

In addition, in order to achieve the above object, a paper sheet management apparatus recited in claim 9 is a paper sheet management apparatus configured to manage a paper sheet handling apparatus having a plurality of stacking units for stacking paper sheets, the paper sheet handling apparatus being configured to sort the paper sheets based on sorting conditions for sorting the paper sheets, the sorting conditions being set for the respective stacking units, and to sequentially stack the sorted paper sheets in the stacking units corresponding to the sorting conditions, the paper sheet management apparatus including: a registration subject specifying unit configured to specify a stacking unit as a registration subject among the plurality of stacking units; a paper sheet detailed information obtaining unit configured to obtain paper sheet detailed information of a paper sheet that is stacked in the stacking unit specified as a registration subject by the registration subject specifying unit; and a registration control unit configured to register, in a storage unit, the paper sheet detailed information obtained by the paper sheet detailed information obtaining unit.

In addition, in order to achieve the above object, a paper sheet management method recited in claim 10 is a paper sheet management method for managing a paper sheet handling apparatus having a plurality of stacking units for stacking paper sheets, the paper sheet handling apparatus being configured to sort the paper sheets based on sorting conditions for sorting the paper sheet, the sorting conditions being set for the respective stacking units, and to sequentially stack the sorted paper sheets in the stacking units corresponding to the sorting conditions, the paper sheet management method including: specifying a stacking unit among the plurality of stacking units, as a registration subject; obtaining paper sheet detailed information of a paper sheet that is stacked in the stacking unit specified as a registration subject in the obtaining; and controlling to register the banknote detailed information obtained in the obtaining in a storage unit.

In order to achieve the above object, a paper sheet management program recited in claim 11 is a paper sheet management program executable by a computer device, for managing a paper sheet handling apparatus having a plurality of stacking units for stacking paper sheets, the paper sheet handling apparatus being configured to sort the paper sheets based on sorting conditions for sorting the paper sheets, the sorting conditions being set for the respective stacking units, and to sequentially stack the sorted paper sheets in the stacking units corresponding to the sorting conditions, the paper sheet management program including: a registration subject specifying process in which a stacking unit as a registration subject is specified among the plurality of stacking units; a paper sheet detailed information obtaining process in which paper sheet detailed information of a paper sheet that is stacked in the stacking unit specified as a registration subject in the registration subject specifying process is obtained; and a registration control process in which the banknote detailed information obtained in the paper sheet detailed information obtaining process is stored in a storage unit.

Effect of the Invention

According to the paper sheet management system recited in claim 1, a stacking unit as a registration subject is specified among the plurality of stacking units, and paper sheet detailed information of a paper sheet that is stacked in the stacking unit specified as a registration subject is registered in the storage unit. Thus, by avoiding registration of unnecessary paper sheet detailed information in the storage unit, a memory capacity of a storage unit and a volume of paper sheet detailed information to be registered in the storage unit can be minimized, as well as a load on the storage unit which is required for searching the paper sheet detailed information can be remarkably reduced.

In addition, according to the paper sheet management system recited in claim 2, the paper sheet management system includes a sorting condition setting unit configured to set the sorting conditions for sorting the paper sheets, for the respective stacking units. Thus, in addition to the effect of claim 1, a user can freely set a sorting condition for each of the stacking units.

In addition, according to the paper sheet management system recited in claim 3, the paper sheet detailed information registered in the storage unit is managed for each sorting condition corresponding to the stacking unit as a registration subject. Thus, in addition to the effect of claim 2, a user can search the paper sheet detailed information registered in the storage unit by each of the sorting conditions.

In addition, according to the paper sheet management system recited in claim 4, the recognition information of the paper sheet, which is identified by the recognition information identifying unit, is included in the paper sheet detailed information, and the paper sheet detailed information including the recognition information is registered in the storage unit. Thus, in addition to any one of the effects of claims 1 to 3, the paper sheet detailed information including the recognition information of the paper sheet can be managed, for example, it is possible to cope with a counterfeit note.

In addition, according to the paper sheet management system recited in claim 5, a paper sheet image of the paper sheet, which is obtained by the image obtaining unit, is included in the paper sheet detailed information, and the paper sheet detailed information including the paper sheet image is registered in the storage unit. Thus, in addition to any one of the effects of claims 1 to 3, the paper sheet detailed information including the paper sheet image of the paper sheet can be managed, it is possible to cope with a counterfeit note, for example.

In addition, according to the paper sheet management system recited in claim 6, a recognition result of the type recognition unit relating to the paper sheet is included in the paper sheet detailed information, and the paper sheet detailed information including the recognition result is registered in the storage unit. Thus, in addition to any one of the effects of claims 1 to 3, the paper sheet detailed information including the paper sheet recognition result of the type recognition unit can be managed.

In addition, according to the paper sheet management system recited in claim 7, a recognition result of the fitness recognition unit relating to the paper sheet is included in the paper sheet detailed information, and the paper sheet detailed information including the recognition result is registered in the storage unit. Thus, in addition to any one of the effect's of claims 1 to 3, the paper sheet detailed information including the paper sheet recognition result of the fitness recognition unit can be managed.

In addition, according to the paper sheet management system recited in claim 8, a stacking unit as a registration subject is specified among the plurality of stacking units, and paper sheet detailed information of a paper sheet that is stacked in the stacking unit specified as a registration subject, among the paper sheet detailed information obtained by the paper sheet detailed information obtaining unit, is stored in a storage unit Thus, by avoiding registration of unnecessary paper sheet detailed information in the storage unit, a memory capacity of a storage unit and a volume of paper sheet detailed information to be registered in the storage unit can be minimized, as well as a load on the storage unit which is required for searching the paper sheet detailed information can be remarkably reduced.

In addition, in the paper sheet management apparatus recited in claim 9, a stacking unit as a registration subject is specified among the plurality of stacking units in the paper sheet handling apparatus, and the paper sheet detailed information of a paper sheet stacked in the stacking unit specified as a registration subject. Thus, by avoiding registration of unnecessary paper sheet detailed information in the storage unit, a memory capacity of a storage unit and a volume of paper sheet detailed information to be registered in the storage unit can be minimized, as well as a load on the storage unit which is required for searching the paper sheet detailed information can be remarkably reduced.

In addition, in the paper sheet management method recited in claim 10, a stacking unit as a registration subject is specified among the plurality of stacking units in the paper sheet handling apparatus, and the paper sheet detailed information of a paper sheet stacked in the stacking unit specified as a registration subject. Thus, by avoiding registration of unnecessary paper sheet detailed information in the storage unit, a memory capacity of a storage unit and a volume of paper sheet detailed information to be registered in the storage unit can be minimized, as well as a load on the storage unit which is required for searching the paper sheet detailed information can be remarkably reduced.

In addition, in the paper sheet management program recited in claim 11, a stacking unit as a registration subject is specified among the plurality of stacking units in the paper sheet handling apparatus, and the paper sheet detailed information of a paper sheet stacked in the stacking unit specified as a registration subject. Thus, by avoiding registration of unnecessary paper sheet detailed information in the storage unit, a memory capacity of a storage unit and a volume of paper sheet detailed information to be registered in the storage unit can be minimized, as well as a load on the storage unit which is required for searching the paper sheet detailed information can be remarkably reduced.

BRIEF DESCRIPTION OF THE DRAWINGS

FIG. 3 is an explanatory view briefly showing table contents of a set mode management table inside a banknote management apparatus.

DESCRIPTION OF THE REFERENCE NUMBERS

Figure 1:
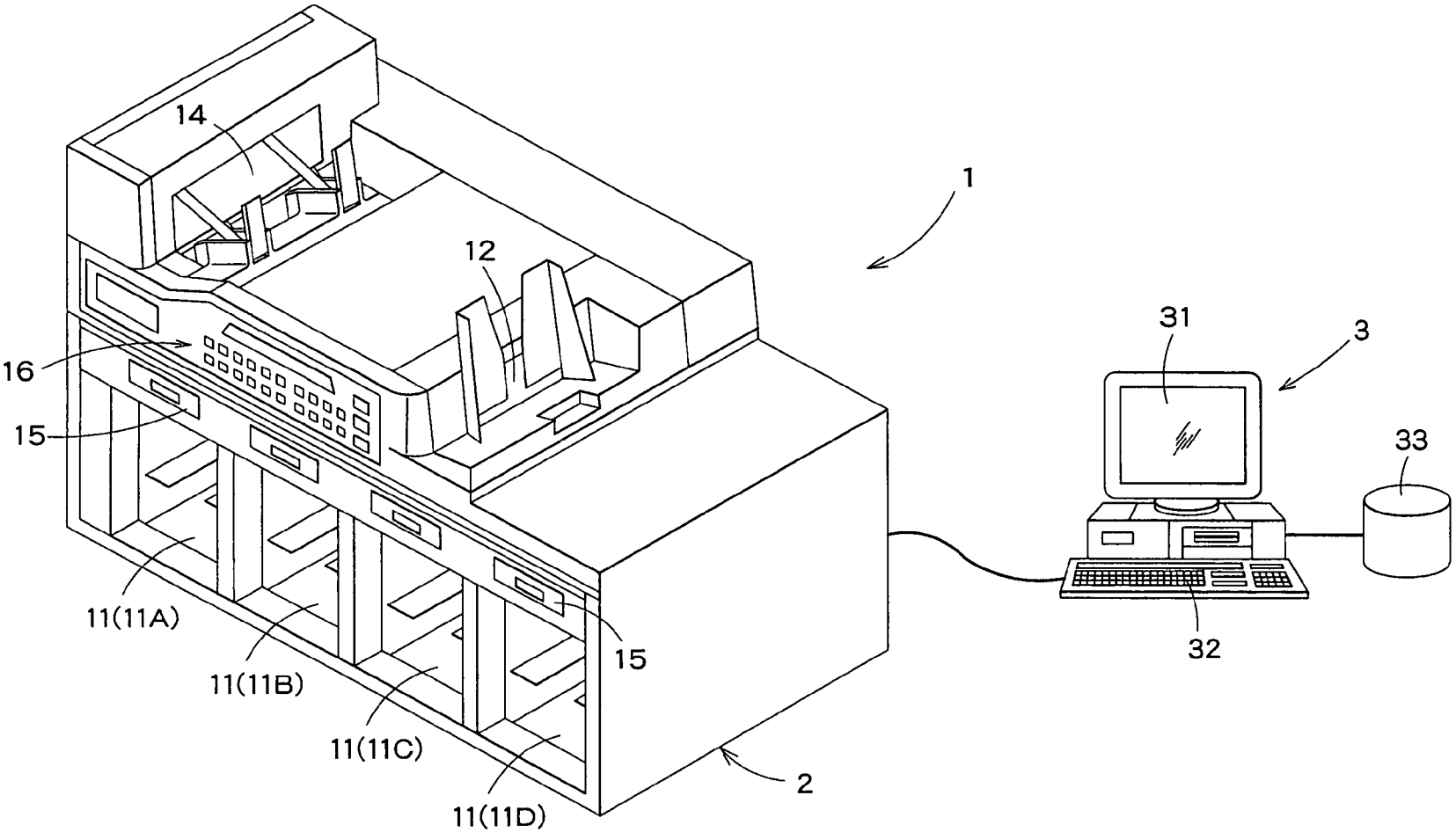
FIG. 1 is a system explanatory view showing a schematic structure of an overall banknote management system in one embodiment.

1 banknote management system
2 banknote handling apparatus
3 banknote management apparatus
11 stacker
20 imaging unit
21A denomination recognition unit
21B fitness recognition unit
32A sorting condition input unit
32B DB registration specifying unit
32C set mode specifying unit
33 database
37A serial number identifying unit
37D DB control unit

BEST MODE FOR CARRYING OUT THE INVENTION

A banknote management system showing an embodiment according to the present invention relating to a paper sheet management system, a paper sheet management apparatus, a paper sheet management method, and a paper sheet management program will be described in detail herebelow with reference to the drawings.

At first, a summary of the embodiment is described. Namely, a user specifies a stacker as a registration subject among a plurality of stackers inside a banknote handling apparatus, and only banknote detailed information about a banknote that is stacked in the specified stacker is registered in a database.

As a result, by avoiding registration of unnecessary paper sheet detailed information in the storage unit, a memory capacity of a storage unit and a volume of paper sheet detailed information to be registered in the storage unit can be minimized, as well as a load on the storage unit which is required for searching the paper sheet detailed information can be remarkably reduced.

Figure 2:
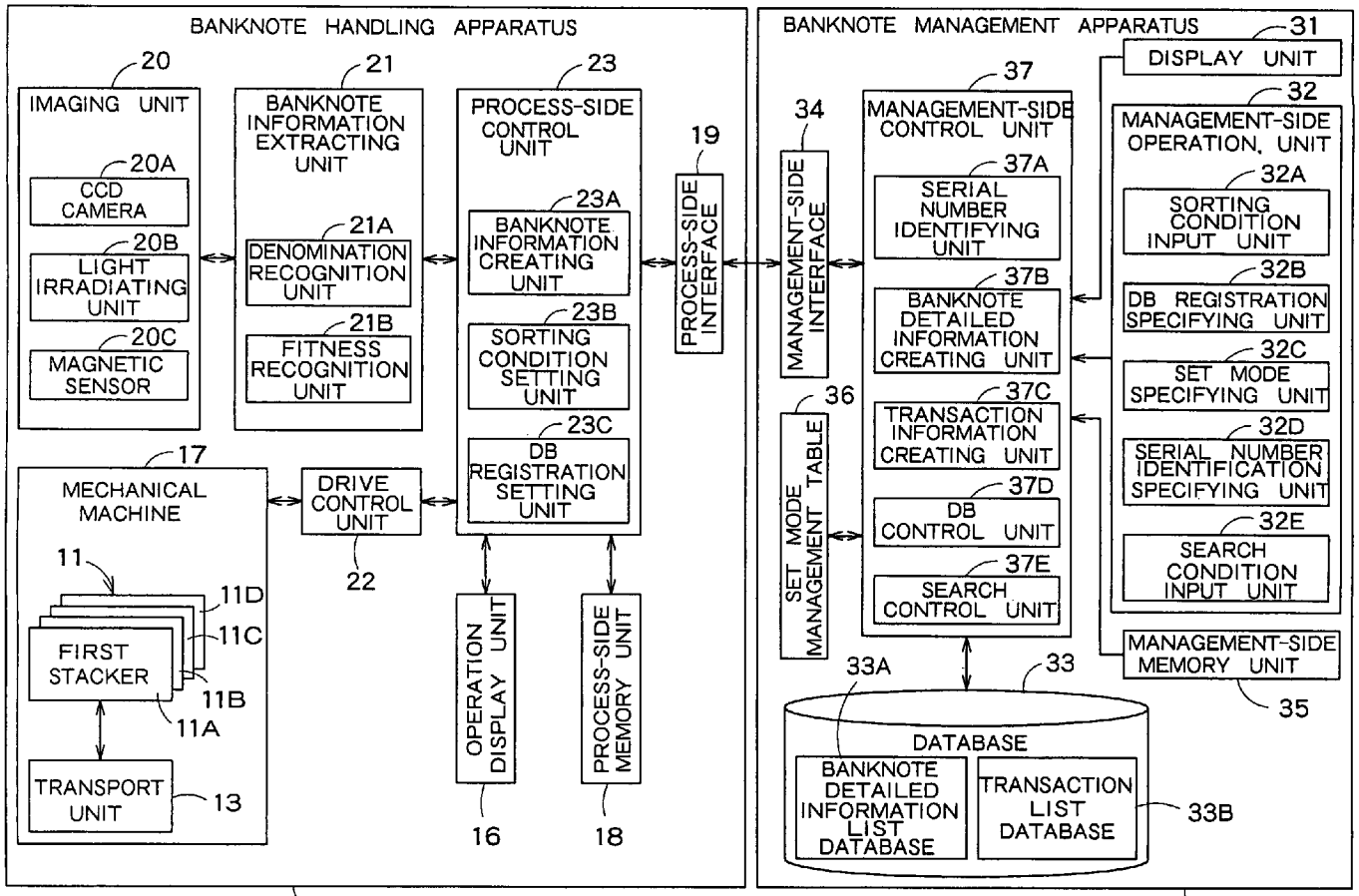
FIG. 2 is a block view showing a schematic structure inside the banknote management system.

FIG. 1 is an explanatory view showing a schematic structure of an overall banknote management system in one embodiment. FIG. 2 is a block view showing a schematic structure inside the banknote management system.

The banknote management system 1 shown in FIG. 1 includes a banknote handling apparatus 2 having a plurality of stackers 11 for stacking banknotes, and a banknote management apparatus 3 such as a personal computer for managing the banknote handling apparatus 2. The banknote handling apparatus 2 is configured to sort banknotes based on sorting conditions set for the respective stackers 11, and to sequentially stack the sorted banknotes in the plurality of stackers 11 corresponding to the sorting conditions.

The banknote handling apparatus 2 includes: a banknote inlet unit 12 through which banknotes are supplied; a transport unit 13 (see, FIG. 2) configured to transport banknotes supplied from the banknote inlet unit 12 one by one; the plurality of stackers 11 configured to sequentially stack the banknotes having been transported by the transport unit 13; a reject unit 14 configured to reject a banknote that does not fall under the aforementioned sorting conditions of the stackers 11; stacker display units 15 configured to display states of the respective stackers 11; and an operation display unit 16 configured to input or display various information. The stacker display unit 15 displays state information such as the number of banknotes counted by the stacker, a batch state, and so on.

The stackers 11 include a first stacker 11A, a second stacker 11B, a third stacker 11C and a fourth stacker 11D, for the respective banknote sorting conditions. The sorting conditions can be suitably changed depending on a specifying operation from the banknote management apparatus 3.

When a banknote having been transported by the transport unit 13 falls under the sorting condition of the first stacker 11A, the banknote handling apparatus 2 stacks the banknote in the first stacker 11A. Similarly, when a banknote having been transported by the transport unit 13 falls under the sorting condition of the second stacker 11B, the banknote handling apparatus 2 stacks the banknote in the second stacker 11B. When a banknote having been transported by the transport unit 13 falls under the sorting condition for the third stacker 11C, the banknote handling apparatus 2 stacks the banknote in the third stacker 11C. When a banknote having been transported by the transport unit 13 falls under the sorting condition of the fourth stacker 11D, the banknote handling apparatus 2 stacks the banknote in the fourth stacker 11D.

In addition, when a banknote having been transported by the transport unit 13 does not fall under any of the sorting conditions of the first stacker 11A, the second stacker 11B, the third stacker 11C and the fourth stacker 11D, the banknote handing apparatus 2 is configured to transport the banknote to the reject unit 14. A banknote that does not fall under a sorting condition is, for example, an unrecognizable banknote, an abnormally transported banknote, and so on.

The banknote management apparatus 3 is connected to the banknote handling apparatus 2 so as to manage the banknote handling apparatus 2. The banknote management apparatus 3 includes a display unit 31 configured to display various information, a management-side operating unit 32 configured to input various information, and a database 33 configured to register and manage banknote detailed information of a banknote.

The banknote handling apparatus 2 shown in FIG. 2 includes a mechanical machine 17 composed of stackers 11 and the transport unit 13, the operation display unit 16, a process-side memory unit 18 configured to store various information, and a process-side interface 19 serving as a communication interface between the banknote handling apparatus 2 and the banknote management apparatus 3.

Further, the banknote handling apparatus 2 includes a imaging unit 20 configured to image a face image and a back image of a banknote having been transported by the transport unit 13, a banknote information extracting unit 21 configured to extract banknote information from the banknote image imaged by the imaging unit 20, a drive control unit 22 configured to control the drive of the mechanical machine 17, and a process-side control unit 23 configured to control the whole banknote handling apparatus 2.

The imaging unit 20 has a light irradiating unit 20B configured to irradiate plural kinds of light beams, such as a visible light beam, an infrared light beam, a green light beam and so on, onto a banknote having transported by the transport unit 13, and a CCD (Charge Coupled Device) camera 20A.

The imaging unit 20 is configured to sequentially irradiate plural kinds of light beams by the light irradiating unit 20B onto a banknote having transported by the transport unit 13, and to receive reflected lights reflected on the banknote by the CCD camera 20A, so as to image a face image and a back image of the banknote.

Further, the imaging unit 20 is configured to irradiate a light beam by the light irradiating unit 20B onto a banknote, and to receive a transmitted light beam transmitting through a face and a back of the banknote by the CCD camera 20A, so as to image a transmission image of the banknote.

Furthermore, the imaging unit 20 has a magnetic sensor 20C for detecting magnetic distributions of a face and a back of a banknote, and is configured to obtain a magnetic distribution of each banknote detected by the magnetic sensor 20C.

That is to say, the imaging unit 20 is configured to obtain, as a banknote image, a face image and a back image of a banknote having been transported by the transport unit 13, a transmission image of the banknote, and a magnetic distribution of the banknote.

The banknote information extracting unit 21 includes a denomination recognition unit 21A configured to recognize a denomination of a banknote having been transported by the transport unit 13, and a fitness recognition unit 21B configured to recognize whether a banknote having been transported by the transport unit 13 is a fit note or an unfit note.

Based on the banknote image of the banknote obtained from the imaging unit 20, the denomination recognition unit 21A is configured to recognize, for example, in a case of Japanese banknotes, a denomination (whether the banknote is a 10,000-yen banknote, 5,000-yen banknote, 2,000-yen banknote, or a 1,000-yen banknote), and a version (whether the banknote is a new version banknote or an old version banknote). In a case of foreign banknotes, the denomination recognition unit 21A is configured to recognize, in addition to a denomination, an edition number (generation of version) as a part of the denomination.

Based on the banknote image of the banknote obtained from the imaging unit 20, the fitness recognition unit 21B is configured to recognize fitness of the banknote, i.e., whether the banknote is a fit note corresponding to a banknote capable of being loaded into an ATM of a financial institute (hereinafter referred to simply as "ATM FIT note"), a fit note corresponding to a banknote capable of being used in a counter (hereinafter referred to simply as "TELLER FIT note") or an unfit note corresponding to a banknote unsuitable for circulation (hereinafter referred to as "UNFIT note"). As compared with a TELLER FIT note, an ATM FIT note corresponds to a banknote that is less limp and less stained, and thus can smoothly pass through an inside mechanism of the ATM.

The process-side control unit 23 includes a banknote information creating unit 23A configured to create banknote information of a banknote, a sorting condition setting unit 23B configured to set sorting conditions for the respective stackers 11, and a database registration setting unit (hereinafter referred to simply as "DB registration setting unit") 23C configured to set, for each of the stackers 11, whether it is necessary or unnecessary to register information of a banknote (banknote detailed information), which is stacked in the stacker, in the database 33 of the banknote management apparatus 3.

The banknote information creating unit 23A is configured to create, as banknote information, a banknote image from the imaging unit 20, a denomination result of the denomination recognition unit 21A, a fitness result of the fitness recognition unit 21B, and a transaction ID for recognizing a transaction of the banknote.

The sorting condition setting unit 23B is configured to set sorting conditions, such as a denomination result and a fitness result, for the respective stackers 11. For example, a sorting condition in which a 10,000-yen banknote is stacked in the first stacker 11A is set, and a sorting condition in which a 5,000-yen banknote is stacked in the second stacker 11B. In this case, when a banknote having been transported by the transport unit 13 is a 10,000-yen banknote, the process-side control unit 23 stacks the banknote in the first stacker 11A. On the other hand, when a banknote having been transported by the transport unit 13 is a 5,000-yen banknote, the process-side control unit 23 stacks the banknote in the second stacker 11B.

For example, when the DB registration setting unit 23C sets that it is necessary for the first stacker 11A and the third stacker 11C to register information in the database (DB registration is necessary for the first and the third stackers 11A and 11C), and that it is unnecessary for the second stacker 11B and the fourth stacker 11D to register information in the database (DB registration is unnecessary for the second and the fourth stackers), the process-side control unit 23 transmits, in order that banknote detailed information of banknotes stacked in the first stacker 11A and the third stacker 11C is registered in the database 33 of the banknote management apparatus 3, the banknote information to the banknote management apparatus 3 via the process-side interface 19. Meanwhile, the process-side control unit 23 does not transmit banknote information of banknotes stacked in the second stacker 11B and the fourth stacker 11D, in order to avoid registration of the banknote information in the database 33 of the banknote management apparatus 3.

The sorting condition for each stacker 11, which is set by the sorting condition setting unit 23B, and the DB registration necessity for each stacker 11, which is set by the DB registration setting unit 23C, are set depending on a specifying operation of the banknote management apparatus 3.

In addition to the display unit 31, the management-side operating unit 32 and the database 33, the banknote management apparatus 3 includes a management-side interface 34 configured to serve as a communication interface between the banknote management apparatus 3 and the banknote handling apparatus 2, a management-side memory unit 35 configured to store various information, a set mode management table 36 configured to manage set modes described below, and a management-side control unit 37 configured to control the whole banknote management apparatus 3.

FIG. 3 is an explanatory view briefly showing table contents of a set mode management table inside a banknote management apparatus.

The set mode management table shown in FIG. 3 manages the set modes, for example, a teller deposit mode used when a banknote is deposited in a counter, a teller dispense mode used when a banknote is dispensed in a counter, an ATM loading mode used when a banknote is loaded into an ATM, and an account mode used when an unfit note is submitted to an superordinate bank such as Bank of Japan.

When the teller deposit mode is specified, for example, a sorting condition for the first stacker 11A is set as 10,000-yen banknote, a sorting condition for the second stacker 11B is set as 5,000-yen banknote, a sorting condition for the third stacker 11C is set as 2,000-yen banknote, and a sorting condition for the fourth stacker 11D is set as 1,000-yen banknote. In addition, DB registrations for the first to fourth stackers 11A to 11D are set to be necessary (represented as "○").

Alternatively, when the ATM loading mode "1" is specified, a sorting condition for the first stacker 11A is set as ATM FIT banknote, a sorting condition for the second stacker 11B is set as TELLER FIT banknote, a sorting condition for the third stacker 11C is set as UNFIT banknote, and a sorting condition for the fourth stacker 11D is set as others. In addition, DB registrations for the first to third stackers are set to be necessary (represented as "○"), and a DB registration for the fourth stacker is set to be unnecessary (represented as "x").

Alternatively, when the ATM loading mode "2" is specified, a sorting condition for the first stacker 11A is set as UNFIT 10,000-yen banknote, a sorting condition for the second stacker 11B is set as UNFIT 5,000-yen banknote, a sorting condition for the third stacker 11C is set as UNFIT 2,000-yen banknote, and a sorting condition for the fourth stacker 11D is set as UNFIT 1,000-yen banknote. DB registrations for the first stacker 11A and the fourth stacker 11D are set to be necessary (represented as "○"), and DB registrations for the second stacker 11B and the third stacker 11C are set to be unnecessary (represented as "x")

The management-side operating unit 32 includes a sorting condition input unit 32A configured to input sorting conditions for the respective stackers 11 inside the banknote handling apparatus 2, the database registration specifying unit (hereinafter referred to simply as "DB registration specifying unit") 32B configured to set a DB registration necessity for each of the stackers 11, a set mode specifying unit 32C configured to specify a set mode managed in the set mode management table 36, a serial number identification specifying unit 32D configured to specify a serial number identification necessity, and a search condition input unit 32E configured to input a search condition.

The sorting condition input unit 32A is configured to input sorting conditions for the respective stackers 11 inside the banknote handling apparatus 2, on a display screen of the display unit 31.

The DB registration specifying unit 32B is configured to specify DB registration necessities for the respective stackers 11, on the display screen of the display unit. When a DB registration is specified to be necessary, registration of banknote detailed information of a banknote that is stacked in the specified stacker 11 in the database 33 is requested. On the other hand, when a DB registration is specified to be unnecessary, registration of banknote detailed information of a banknote that is stacked in the specified stacker 11 in the database 33 is avoided.

The setting mode specifying unit 32C is configured to specify a desired set mode among a plurality of set modes managed in the set mode management table 36, on the display screen of the display unit 31.

The serial number identification specifying unit 32D is configured to specify an identification necessity of a serial number of a banknote that is stacked in the stacker 11, on the display screen of the display unit 31. When a serial number identification is specified to be necessary, identification of a serial number of a banknote is performed. When a serial number identification is specified to be unnecessary, identification of a serial number of a banknote is not performed.

The management-side control unit 37 can register a new set mode in the set mode management table 36 by resetting sorting conditions and DB registration necessities for the first to fourth stackers 11A to 11D, with the use of the sorting condition input unit 32A and the DB registration specifying unit 32B.

The search condition input unit 32E is configured to input a search condition for searching banknote detailed information to be searched from the database 33, on the display screen of the display unit 31.

The management-side control unit 37 includes a serial number identifying unit 37A configured to identify a serial number of a banknote based on a banknote information of banknote information transmitted from the banknote handling apparatus 2, a banknote detailed information creating unit 37B configured to create banknote detailed information from the banknote information transmitted from the banknote handling apparatus 2 and the serial number identified by the serial number recognizing unit 37A, a transaction information creating unit 37C configured to generate transaction information about the transaction of the banknote, a database control unit (hereinafter referred to simply as "DB control unit") 37D configured to control registration of information in the database 33, and a search control unit 37D configured to search, from the database 33, banknote detailed information corresponding to the search condition inputted by the search condition input unit 32E.

The serial number identifying unit 37A is configured to extract a predetermined area of a serial number from a banknote image, to identify the serial number as characters from the extracted predetermined area, and to recognize the character identification result as the serial number.

The banknote detailed information creating unit 37B is configured to create banknote detailed information from banknote information from the banknote handling apparatus 2 and a serial number identified by the serial number identifying unit 37A.

Figure 4:
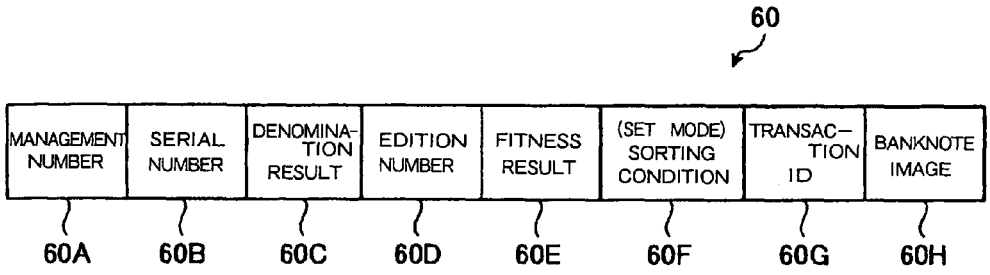
FIG. 4 is an explanatory view briefly showing a data structure of banknote detailed information.

FIG. 4 is an explanatory view briefly showing a data structure of banknote detailed information.

Banknote detailed information 60 shown in FIG. 4 includes a management number 60A for recognizing a banknote, a serial number 60B of the banknote, a denomination result 60C of the banknote, an edition number 60D of the banknote, a fitness result 60E of the banknote, a sorting condition (or a set mode) 60F of the stacker 11 in which the banknote is sorted and stacked, a transaction ID 60G of the banknote, and a banknote image 60H of the banknote.

The transaction information creating unit 37C is configured to create transaction information as contents of transaction ID 60G of the banknote detailed information created by the banknote detailed information creating unit 37B.

Figure 5:
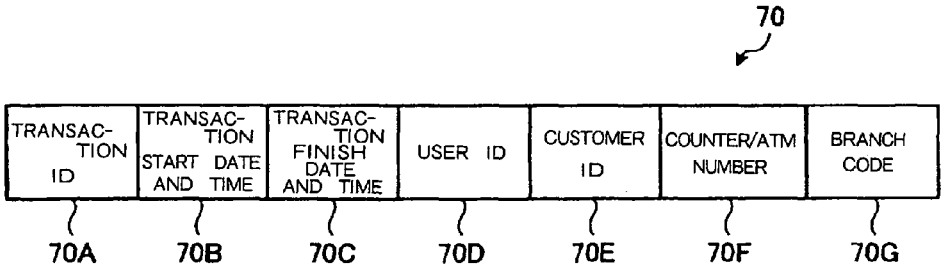
FIG. 5 is an explanatory view briefly showing a data structure of transaction information.

FIG. 5 is an explanatory view briefly showing a data structure of transaction information.

Transaction information 70 shown in FIG. 5 includes a transaction ID 70A of a banknote, a transaction start date and time of the banknote 70B, a transaction finish date and time of the banknote 70C, a user ID 70D for recognizing a dealer of the banknote, a customer ID 70E for recognizing a client of the banknote, a counter/ATM number 70F for recognizing a counter or an ATM in which the banknote was transacted, and a branch code 70G for recognizing a store in which the banknote was transacted.

The database 33 includes a banknote detailed information list database 33A in which banknote detailed information is registered, and a transaction list database 33B in which transaction information is registered.

The DB control unit 37D is configured to register, in the database 33, only banknote detailed information and transaction information of a banknote that is stacked in the stacker 11, a DB registration of which is specified to be necessary by the DB registration specifying unit 32B.

The search control unit 37E is configured to search banknote information and transaction information registered in the database 33, which correspond to a search condition having been inputted by the search condition input unit 32E, and to display the search result on the display screen of the display unit 31.

The management-side control unit 37 can print out the search result.

Figure 6:
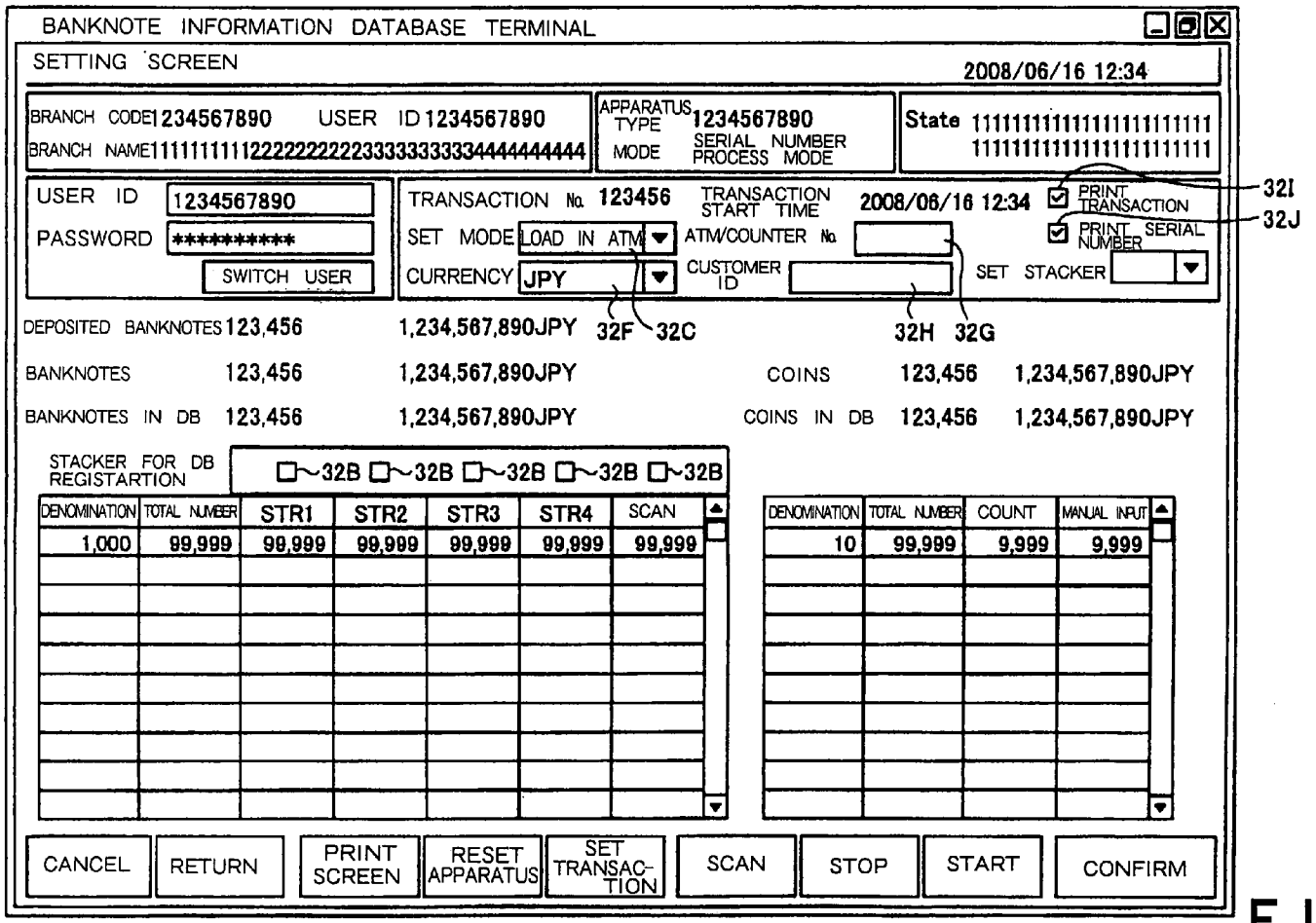
FIG. 6 is an explanatory view briefly showing a setting screen displayed on a display unit of the banknote management apparatus.

FIG. 6 is an explanatory view briefly showing a setting screen displayed on the display unit 31 of the banknote management apparatus 3.

The setting screen shown in FIG. 6 includes, in addition to the DB registration specifying unit 32B and the set mode specifying unit 32C, for example, a currency specifying unit 32F configured to specify a transaction currency such as Japanese yen and Chinese yuan, an ATM/counter specifying unit 32G configured to specify an ATM or a counter, a client ID specifying unit 32H configured to specify a client ID, a transaction print specifying unit 32I configured to print out transaction contents, and a serial number print specifying unit 32J configured to print out a serial number of a transacted banknote.

The DB registration specifying unit 32B corresponds to check boxes, for example. By checking or not checking the check boxes for the respective stackers, DB registration necessities are specified. When a banknote cannot be sorted by the sorting conditions of the stackers 11, a scanning operation of the banknote is performed, for example. At this time, a check box, by which the registration necessity of the banknote detailed information obtained by the scanning operation in the database 33 is set, also corresponds to the DB registration specifying unit 32B.

The paper sheet management system recited in the claims corresponds to the banknote management system 1. Similarly, a paper sheet corresponds to a banknote. The stacking unit corresponds to the stacker 11. The paper sheet handling apparatus corresponds to the banknote handling apparatus 2. The paper sheet management apparatus corresponds to the banknote management apparatus 3. The registration subject specifying unit corresponds to the DB registration specifying unit 32B. Paper sheet detailed information corresponds to banknote detailed information. The paper sheet detailed information obtaining unit corresponds to the banknote information extracting unit 21. The serial number identifying unit 37A and the banknote detailed information creating unit 37B. The storage unit corresponds to the database 33. The registration control unit corresponds to the DB control unit 37D. The sorting condition setting unit corresponds to the sorting condition input unit 32A and the set mode specifying unit 32C. Recognition information corresponds to a serial number. The recognition information identifying unit corresponds to the serial number identifying unit 37A. The image obtaining unit corresponds to the imaging unit 20. A type of a paper sheet corresponds to a denomination. The type recognition unit corresponds to the denomination recognition unit 21A. The fitness recognition unit corresponds to the fitness recognition unit 21B.

Figure 7:
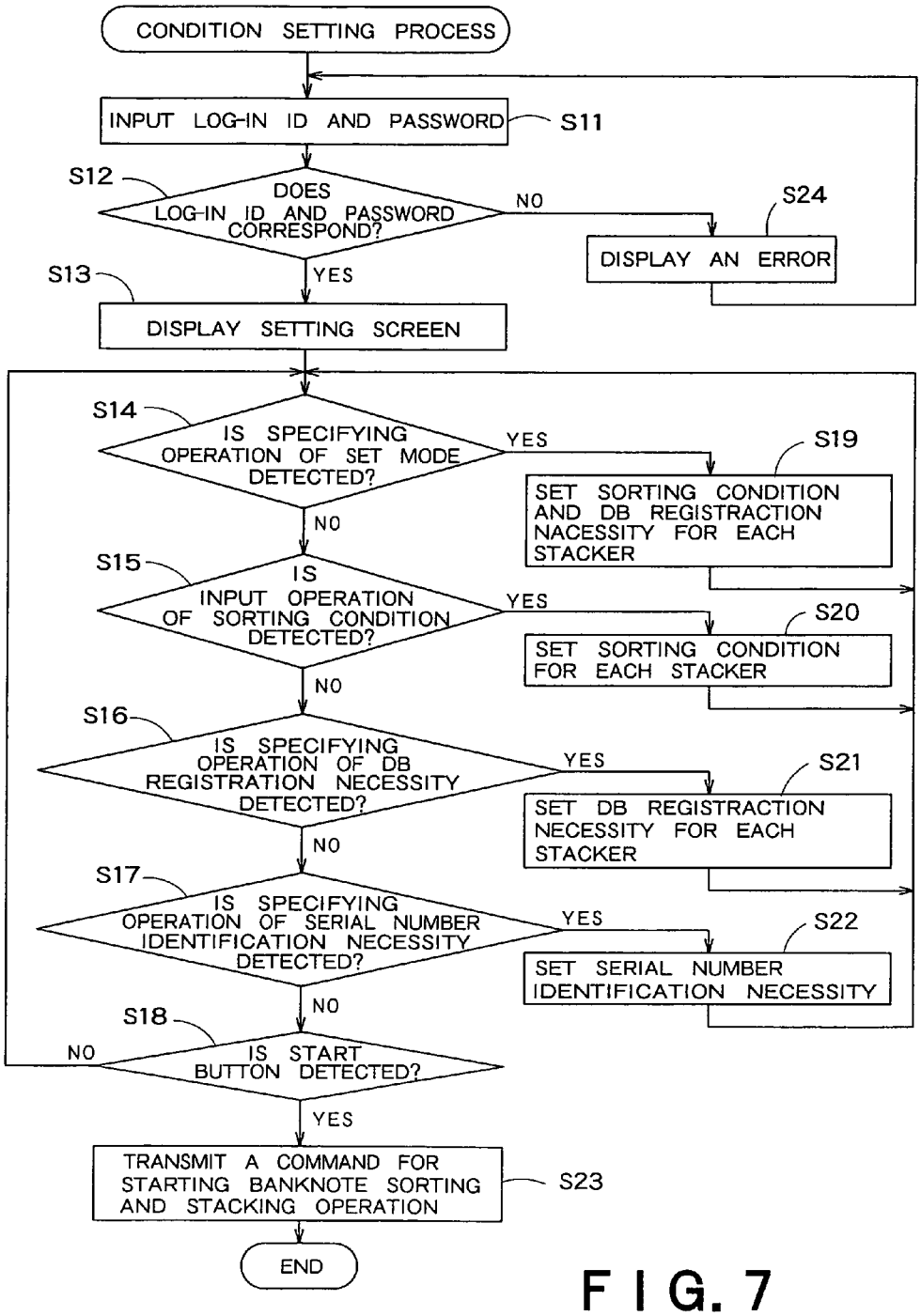
FIG. 7 is a flowchart showing a process operation relating to a condition setting process inside the banknote management apparatus.

Next, an operation of the banknote management system 1 in this embodiment is described. FIG. 7 is a flowchart showing a process operation relating to a condition setting process inside the banknote management apparatus 3.

The condition setting process shown in FIG. 7 is a process performed by the banknote management apparatus 3, for setting conditions such as sorting conditions and DB registration necessities for the stackers 11 inside the banknote handling apparatus 2.

In FIG. 7, when a log-in ID and a password are inputted on the display screen of the display unit 31 through the management-side operating unit 32 (step S11), the management-side control unit 37 judges whether the log-in ID and the password correspond to a log-in ID for identifying a user and a password therefor (step S12). The log-in ID and the password for identifying a user are set beforehand.

When the log-in IDs and the passwords correspond to each other (step S12: Yes), the management-side control unit 37 identifies the user, and displays the setting screen (see, FIG. 6) on the display screen of the display unit 31 (step S13).

The management-side control unit 37 judges whether a set mode specifying operation by the set mode specifying unit 32C is detected or not (step S14). The user specifies a desired set mode among the plurality of set modes managed in the set mode management table 36, by using the set mode specifying unit 32C.

When a set mode specifying operation by the set mode specifying unit 32C is not detected (step S14: No), the management-side control unit 37 judges whether a sorting condition input operation for each stacker 11 by the sorting condition input unit 32A is detected or not (step S15). The user inputs sorting conditions for the respective stackers 11, by using the sorting condition input unit 32A.

When a sorting condition input operation for each stacker 11 by the sorting condition input unit 32A is not detected (step S15: No), the management-side control unit 37 judges whether a DB registration necessity specifying operation for each stacker 11 by the DB registration specifying unit 32B is detected or not (step S16). The user specifies a DB registration necessity for each stacker 11, by using the DB registration specifying unit 32B.

When a specifying operation of a DB registration necessity for each stacker 11 by the DB registration specifying unit 32B is not detected (steps S16: No), the management-side control unit 37 judges whether a specifying operation of a serial number identification necessity by the serial number identification specifying unit 32D is detected or not (step S17). The user specifies a serial number identification necessity, by using the serial number identification specifying unit 32D.

When a specifying operation of a serial number identification necessity of by the serial number identification specifying unit 32D is not detected (step S17: No), the management-side control unit 37 judges whether a button operation of a start button for starting a counting operation of the banknote handling apparatus 2 is detected or not (step S18).

When a button operation of the start button is not detected (step S18: No), the management-side control unit 37 returns the process to the step S14 so as to judge whether a set mode specifying operation by the set mode specifying unit 32C is detected or not.

When a set mode specifying operation by the set mode specifying unit 32C is detected in the step S14 (step S14: Yes), the management-side control unit 37 instructs the sorting condition setting unit 23B and the DB registration setting unit 23C inside the banknote handling apparatus 2 to set the sorting condition and the DB registration necessity for each stacker 11 according to the set mode; in the sorting condition setting unit 23B and the DB registration setting unit 23C (step S19). Then, the management-side control unit 37 returns the process to the step S14.

The management-side control unit 37 reads out a sorting condition and a DB registration necessity for each stacker 11 depending on the set mode specified by the set mode specifying unit 32C, from the set mode management table 36, and sets the sorting condition and the DB registration necessity read-out for each stacker 11 in the sorting condition setting unit 23B and the DB registration setting unit 23C inside the banknote handling apparatus 2.

When a sorting condition input operation for each stacker 11 by the sorting condition input unit 32A is detected in the step S15 (step S15: Yes), the management-side control unit 37 instructs the sorting condition setting unit 23B inside the banknote handling apparatus to set the sorting condition for each stacker 11 in the sorting condition setting unit 23B (step S20). Then, the management-side control unit 37 returns the process to the step S14.

When a specifying operation of a DB registration necessity for each stacker 11 by the DB registration specifying unit 32B is detected in the step S16 (step S16: Yes), the management-side control unit 37 instructs the DB registration setting unit 23C inside the banknote handling apparatus 2 to set the DB registration necessity for each stacker 11 in the DB registration setting unit 23C (step S21). Then, the management-side control unit 37 returns the process to the step S14.

When a specifying operation of a serial number identification necessity by the serial number identification specifying unit 32D is detected in the step S17 (step S17: YES), the management-side control unit 37 sets the serial number identification necessity in the serial number identifying unit 37A (step S 22). Then, the management-side control unit 37 returns the process to the step S14.

When a button operation of the start button is detected in the step S18 (step S18: Yes), the management-side control unit 37 transmits a command for starting a banknote sorting and stacking process (see, FIG. 8) to the banknote handling apparatus 2 (step S23), and then finishes the process operation shown in FIG. 7.

Alternatively, when the log-in IDs and the passwords do not correspond to each other in the step S12 (step S12: No), the management-side control unit 37 judges that a user cannot be identified, and displays an error on the display unit 31 (step S24). Then, the management-side control unit 37 returns the process to the step S11 so as to input a log-in ID and a password again.

In the condition setting process shown in FIG. 7, a sorting condition and a DB registration necessity for each stacker 11 inside the banknote handling apparatus 2 can be set according to a set mode specifying operation by the set mode specifying unit 32C of the banknote management apparatus 3. Thus, the user can set a sorting condition and a DB registration necessity for each stacker 11, by a simple specifying operation.

In addition, in the condition setting process, a sorting condition for each stacker 11 inside the banknote handling apparatus 2 can be set according to a sorting condition input operation by the sorting condition input unit 32A of the banknote management apparatus 3. Thus, the user can freely set a sorting condition for each stacker 11.

In addition, in the condition setting process, a DB registration necessity for each stacker 11 inside the banknote handling apparatus 2 can be set according to a DB registration necessity specifying operation by the DB registration specifying unit 32B of the banknote management apparatus 3. Thus, the user can freely set a DB registration necessity for each stacker 11.

In addition, in the condition setting process, a serial number identification necessity can be set according to a specifying operation of a serial number identification necessity by the serial number identification specifying unit 32D of the banknote management apparatus 3. Thus, the user can freely set a serial number identification necessity.

Figure 8:
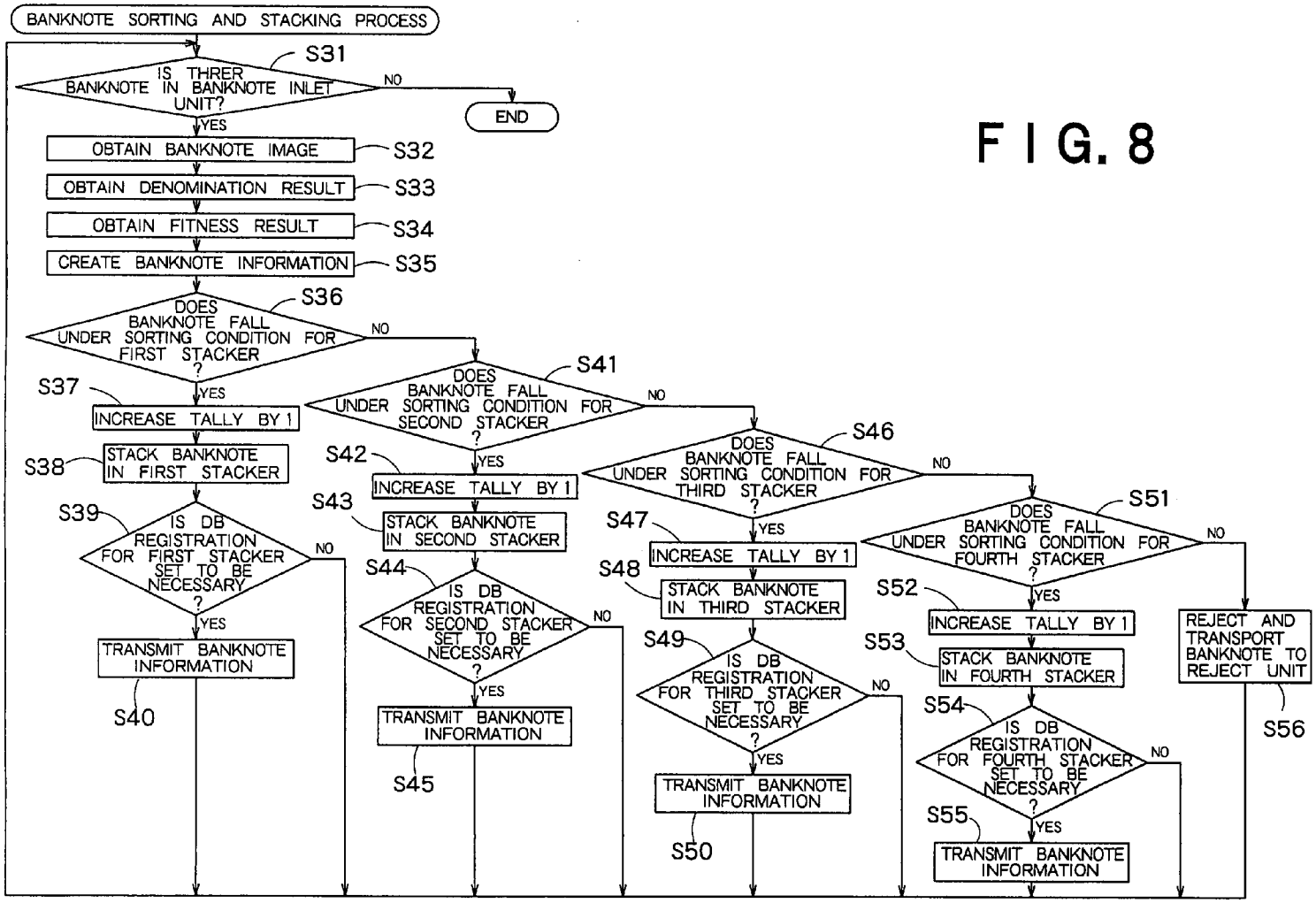
FIG. 8 is a flowchart showing a process operation relating to a banknote sorting and stacking process inside the banknote handling apparatus.

FIG. 8 is a flowchart showing a process operation relating to a banknote sorting and stacking process inside the banknote handling apparatus 2.

The banknote sorting and stacking process shown in FIG. 8 is a process for sorting and stacking banknotes having been transported by the transport unit 13, depending on sorting conditions set for the respective stackers 11.

In FIG. 8, the process-side control unit 23 judges whether there is a banknote in the banknote inlet unit 12 or not (step S31). When there is(are) a banknote(s) in the banknote inlet unit 12, the transport unit 13 transports the banknote(s) in the banknote inlet unit 12 one by one.

When there is a banknote in the banknote inlet unit 12 (step S31: Yes), the imaging unit 20 obtains a banknote image of the banknote (step S32). The imaging unit 20 obtains, as the banknote image, a face image and a back image of the banknote, a transmission image of the banknote, and a magnetic distribution of the banknote.

When the banknote image of the banknote is obtained, the denomination recognition unit 21A inside the banknote information extracting unit 21 recognizes a denomination of the banknote so as to obtain a denomination result (step S33).

In addition, after the denomination result has been recognized, the fitness recognition unit 21B inside the banknote information extracting unit 21 recognizes a fitness of the banknote so as to obtain a fitness result (step S34).

The banknote information creating unit 23A inside the process-side control unit 23 creates the banknote image of the banknote, the denomination result of the banknote, the fitness result of the banknote, and the transaction ID of the banknote as banknote information (steps S35).

Based on the banknote information, the process-side control unit 23 judges whether the banknote falls under the sorting condition set for the first stacker 11A or not (step S36). The sorting condition setting unit 23B has already set sorting conditions for the respective stackers 11 depending on a setting operation by the banknote management apparatus 3.

When the banknote falls under the sorting condition set for the first stacker 11A (step 36: Yes), the process-side control unit 23 counts the banknote entering the first stacker 11A and accordingly increases the tally by an increment of one (step S37), and stacks the banknote in the first stacker 11A through the drive control unit 22 (step S38).

The process-side control unit 23 judges whether the DB registration for the first stacker 11A is set to be necessary or unnecessary (step S39). The DB registration setting unit 23C has already set DB registration necessities for the respective stackers 11 depending on a setting operation by the banknote management apparatus 3.

When the DB registration for the first stacker 11A is set to be necessary (step S39: Yes), the process-side control unit 23 transmits the banknote information of the banknote to the banknote management apparatus 3 through the process-side interface 19 (step S40). Then, the process-side control unit 23 returns the process to the step S31 so as to detect a succeeding banknote.

When the DB registration for the first stacker 11A is set to be unnecessary in the step S39 (step S39: No), the process-side control unit 23 judges that, the DB registration is unnecessary. Then, the process-side control unit 23 returns the process to the step S31 so as to detect a succeeding banknote. When it is judged that the DB registration is unnecessary, the process-side control unit 23 does not transmit the banknote information of the banknote that is stacked in the first stacker 11A to the banknote management apparatus 3.

When the banknote does not fall under the sorting condition set for the first stacker 11A (step S36: No), the process-side control unit 23 judges whether the banknote falls under the sorting condition set for the second stacker 11B or not (step S41).

When the banknote falls under the sorting condition set for the second stacker 11B (steps S41: Yes), the process-side control unit 23 counts the banknote entering the second stacker 11B and accordingly increases the tally by an increment of one (step S42), and stacks the banknote in the second stacker 11B through the drive control unit 22 (step S43).

Then, the process-side control unit 23 judges whether the DB registration for the second stacker 11B is set to be necessary or unnecessary (step S44).

When the DB registration for the second stacker 11B is set to be necessary (step S44: Yes), the process-side control unit 23 transmits the banknote information of the banknote to the banknote management apparatus 3 through the process-side interface 19 (step S45). Then, the process-side control unit 23 returns the process to the step S31 so as to detect a succeeding banknote.

When the DB registration necessity of banknote information of the banknote in the second stacker 11B is set to be unnecessary in the step S44 (step S44: No), the process-side control unit 23 judges that the DB registration is unnecessary. Then, the process-side control unit 23 returns the process to the step S31 so as to detect a succeeding banknote. When it is judged that the DB registration is unnecessary, the process-side control unit 23 does not transmit the banknote information of the banknote that is stacked in the second stacker 11B to the banknote management apparatus 3.

When the banknote does not fall under the sorting condition set for the second stacker 11B (step S41: No), the process-side control unit 23 judges whether the banknote falls under the sorting condition set for the third stacker 11C or not (step S46).

When the banknote falls under the sorting condition set for the third stacker 11C (step S46: Yes), the process-side control unit 23 counts the banknote entering the third stacker 11C and accordingly increases the tally by an increment of one (step S47), and stacks the banknote in the third stacker 11C through the drive control unit 22 (step S48).

Then, the process-side control unit 23 judges whether the DB registration for the third stacker 11C is set to be necessary or unnecessary (step S49).

When the DB registration for the third stacker 11C is set to be necessary (step S49: Yes), the process-side control unit 23 transmits the banknote information of the banknote to the banknote management apparatus 3 through the process-side interface 19 (steps S50). Then, the process-side control unit 23 returns the process to the step S31 so as to detect a succeeding banknote.

When the DB registration of banknote information of the banknote in the third stacker 11C is set to be unnecessary in the step S49 (step S49: No), the process-side control unit 23 judges that the DB registration is unnecessary. Then, the process-side control unit 23 returns the process to the step S31 so as to detect a succeeding banknote. When it is judged that the DB registration is unnecessary, the process-side control unit 23 does not transmit the banknote information of the banknote that is stacked in the third stacker 11C to the banknote management apparatus 3.

When the banknote does not fall under the sorting condition set for the third stacker 11C (step S46: No), the process-side control unit 23 judges whether the banknote falls under the sorting condition set for the fourth stacker 11D or not (step S51).

When the banknote falls under the sorting condition set for the fourth stacker 11D (step S50: Yes), the process-side control unit 23 counts the banknote entering the fourth stacker 11D and accordingly increases the tally by an increment of one (step S52), and stacks the banknote in the fourth stacker 11D through the drive control unit 22 (step S53).

Then, the process-side control unit 23 judges whether the DB registration for the fourth stacker 11D is set to be necessary or unnecessary (step S54).

When the DB registration for the fourth stacker 11D is set to be necessary (step S54: Yes), the process-side control unit 23 transmits the banknote information of the banknote to the banknote management apparatus 3 through the process-side interface 19 (steps S55). Then, the process-side control unit 23 returns the process to the step S31 so as to detect a succeeding banknote.

When the DB registration of banknote information of the banknote in the fourth stacker 11D is set to be unnecessary in the step S54 (step S54: No), the process-side control unit 23 judges that the DB registration is unnecessary. Then, the process-side control unit 23 returns the process to the step S31 so as to detect a succeeding banknote. When it is judged that the DB registration is unnecessary, the process-side control unit 23 does not transmit the banknote information of the banknote that is stacked in the fourth stacker 11D to the banknote management apparatus 3.

When the banknote does not fall under the sorting condition set for the fourth stacker 11D (step S51: No), the process-side control unit 23 judges that there is no sorting condition for the stacker 11 under which the banknote falls. Thus, the process-side control unit 23 rejects the banknote and transports the same to the reject unit 14 through the drive control unit 22 (step S56). Then, the process-side control unit 23 returns the process to the step S31 so as to detect a succeeding banknote.

When there is no banknote anymore in the banknote inlet unit 12 (step S31: No), the process-side control unit 23 finishes the process operation shown in FIG. 8.

In the banknote sorting and stacking process shown in FIG. 8, the process is performed based on the sorting conditions and the DB registration necessities set for the respective stackers 11. When a banknote having been transported by the transport unit 13 falls under any one of the sorting conditions, the banknote is sorted and stacked in the stacker 11 falling under the sorting condition. When the DB registration for this stacker is set to be necessary, information of the banknote (banknote detailed information) stacked in the stacker, a DB registration of which is set to be necessary, is transmitted to the banknote management apparatus 3, such that the banknote detailed information is registered in the database 33 of the banknote management apparatus. Thus, banknotes can be sorted and stacked depending on the sorting conditions for the respective stackers 11, and banknote detailed information can be registered in the database 33 of the banknote management apparatus 3.

In addition, in the banknote sorting and stacking process, when the DB registration for a certain stacker 11 is set to be unnecessary, it is unnecessary to register information of the banknote (banknote detailed information) stacked in this stacker 11 in the database 33 of the banknote management apparatus 3, and the banknote information is not transmitted to the banknote management apparatus 3. Thus, while banknotes can be sorted and stacked based on the sorting conditions set for the respective stackers 11, transmission of unnecessary banknote information to the banknote management apparatus 3 is prevented, whereby registration of unnecessary banknote detailed information in the database 33 of the banknote management apparatus 3 can be avoided.

Figure 9:
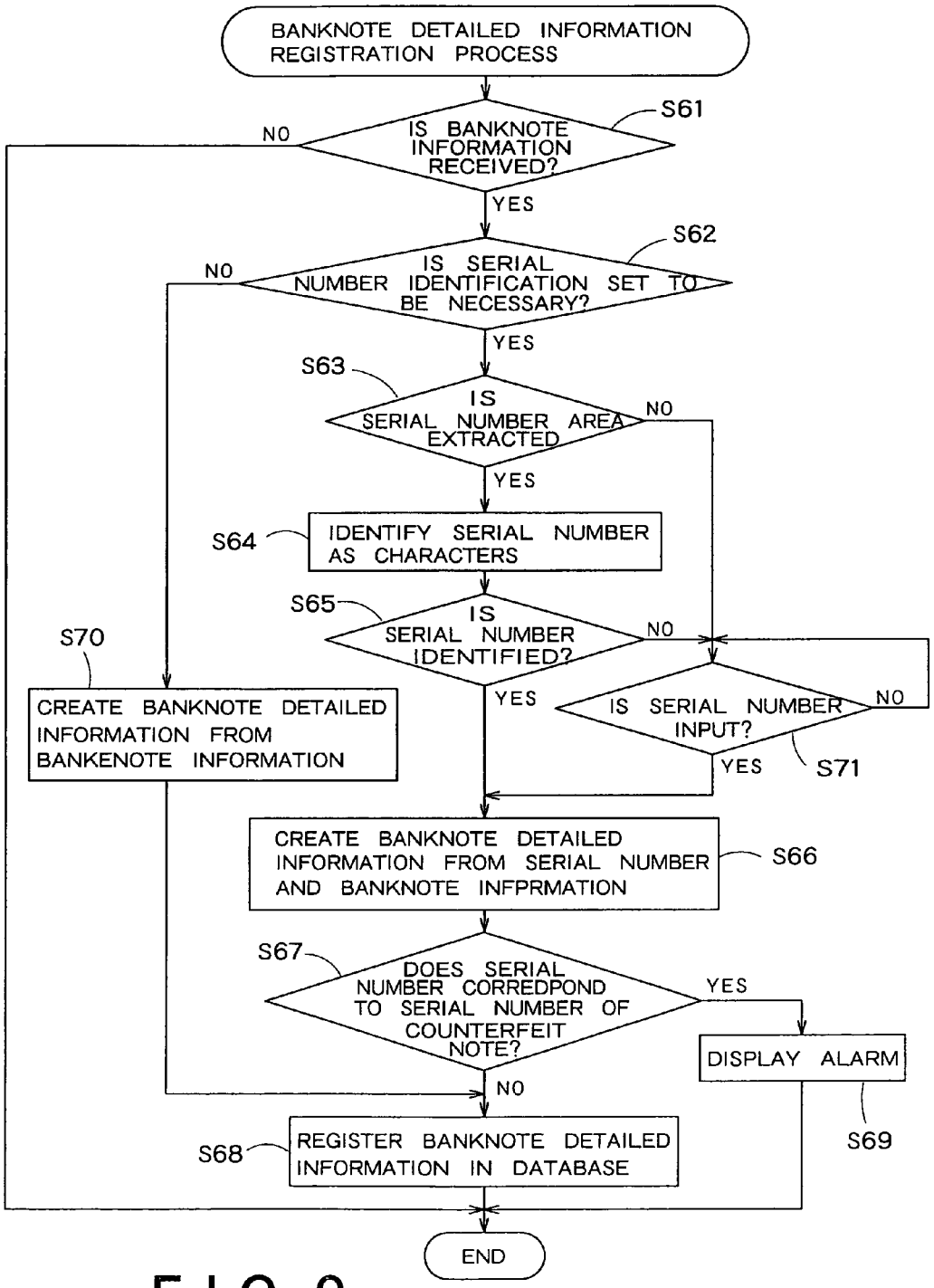
FIG. 9 is a flowchart showing a process operation relating to a banknote detailed information registration process inside the banknote management apparatus.

FIG. 9 is a flowchart showing a process operation relating to a banknote detailed information registering process inside the banknote management apparatus 3.

The banknote detailed information registration process shown in FIG. 9 is a process for identifying a serial number from a banknote image of banknote information transmitted from the banknote handling apparatus 2, and for registering, as banknote detailed information, the serial number and the banknote information in the database 33.

In FIG. 9, the management-side control unit 37 judges whether banknote information is transmitted from the banknote handling apparatus 2 through the management-side interface 34 or not (step S61).

When banknote information is received (step S61: Yes), the management-side control unit 37 judges whether the serial number identification is set to be necessary or unnecessary (step S62). The serial number identification necessity is determined by a specifying operation of the serial number identification specifying unit 32D.

When the serial number identification necessity is set to be necessary (step S62: Yes), the serial number identifying unit 37A inside the management-side control unit 37 judges whether a predetermined serial number area of the banknote image included in the banknote information is extracted or not (step S63).

When the predetermined serial number area of the banknote image is extracted (step S63: Yes), the serial number identifying unit 37A identifies the serial number area as characters (step S64).

When the serial number area is identified as characters, the serial number identifying unit 37A judges whether the serial number is identified or not (steps S65).

When the serial number is identified by the serial number identifying unit 37A (step S65: Yes), the banknote detailed information creating unit 37B inside the management-side control unit 37 creates banknote detailed information by putting together the serial number and the banknote information of the recognized banknote (step S66).

When the banknote detailed information is created, the management-side control unit 37 judges whether the serial number of the banknote detailed information of the banknote corresponds to a serial number in a counterfeit note list or not (step S67). Serial numbers in the counterfeit note list correspond to a list of serial numbers obtained from a police or the like, for example.

When the serial number of the banknote does not correspond to a serial number in the counterfeit note list (step S67: No), the DB control unit 37D inside the management-side control unit 37 registers the banknote detailed information in the banknote detailed information list database 33A inside the database 33 (step S68), and finishes the process operation shown in FIG. 9.

When the serial number of the banknote correspond to a serial number in the counterfeit note list (step S67: Yes), the management-side control unit 37 causes the display unit 31 to display an alarm (step S69), and finishes the process operation shown in FIG. 9. Based on the alarm display on the display unit 31, the user can know that the banknote is a counterfeit note.

When the serial number identification is not set to be necessary in the step S62 (step S62: No), namely, the serial number identification is unnecessary, the banknote detailed information creating unit 37B creates banknote detailed information from the received banknote information (step S70). Then, the process proceeds to the step S68 so as to register the thus created banknote detailed information in the database 33.

When the predetermined serial number area of the banknote image is not extracted in the step S63 (step S63: No), or when the serial number cannot be identified in the step S65 (step S65: No), the serial number identifying unit 37A judges whether a serial number input operation is detected or not (step S71). The serial number input operation is a manual operation for inputting the serial number.

When a serial number input operation is detected by the serial number identifying unit 37A (step S71: Yes), the process proceeds to the step S66 in order to create banknote detailed information from the serial number and the banknote information.

When a serial number input operation is not detected by the serial number identifying unit 37A (step S71: No), the process remains in the step S71 until a serial number input operation is detected.

In the banknote detailed information registration process shown in FIG. 9, when banknote information transmitted from the banknote handling apparatus 2 is received while the serial number identification is set to be necessary, a serial number is identified from the banknote image of the banknote information, and the serial number and the banknote information are registered in the database 33 as banknote detailed information. Namely, since banknote detailed information of a banknote that is stacked in the stacker 11, a DB registration of which is set to be necessary by the banknote handling apparatus 2, is registered in the database 33, registration of unnecessary banknote detailed information can be avoided. Thus, a memory capacity of the database 33 and a registration volume of banknote detailed information including a serial number can be minimized.

In addition, in the banknote detailed information registration process, when banknote information transmitted from the banknote handling apparatus 2 is received while the serial number identification is set to be unnecessary, the banknote information is registered in the database 33 as banknote detailed information. Namely, since banknote detailed information of a banknote that is stacked in the stacker 11, a DB registration of which is set to be necessary by the banknote handling apparatus 2, is registered in the database 33, registration of unnecessary banknote detailed information can be avoided. Thus, a memory capacity of the database 33 and a registration volume of banknote detailed information not including a serial number can be minimized.

In addition, in the banknote detailed information registration process, when banknote information is not transmitted from the banknote handling apparatus 2, it is unnecessary to create banknote detailed information relating to the banknote information or to register the banknote detailed information in the database 33. Thus, by avoiding registration of unnecessary banknote detailed information, a memory capacity of the database 33 and a registration volume of banknote detailed information can be minimized.

In addition, the search control unit 37E inside the management-side control unit 37 of the banknote management apparatus 3 inputs a search condition included in items of banknote detailed information through the search condition input unit 32E, searches banknote detailed information corresponding to the search condition from the database 33, and displays the search result on the display screen of the display unit 31.

When the same search condition as the sorting condition, e.g., UNFIT 10,000-yen banknote, is inputted, the search control unit 37E can search banknote detailed information relating to an UNFIT 10,000-yen banknote from the database 33, and can display the search result on the display screen of the display unit 31.

In addition, since the search control unit 37E does not register unnecessary banknote detailed information in the database 33, a registration volume of banknote detailed information registered in the database 33 can be minimized. Thus, a time period required for a search operation can be remarkably reduced, and thus a load required to search banknote detailed information can be remarkably reduced.

According to this embodiment, a stacker 11 a DB registration of which is necessary is specified among the plurality of stackers 11, and banknote detailed information of a banknote that is stacked in the specified stacker 11 is registered in the database 33. As a result, since registration of unnecessary banknote detailed information in the database 33 is avoided, a memory capacity of the database 33 and a volume of banknote detailed information to be registered in the database 33 can be minimized, as well as a load on the database 33 which is required for search of the banknote detailed information can be remarkably reduced.

In addition, according to this embodiment, there is provided the sorting condition input unit 32A for setting sorting conditions for sorting banknotes for the respective stackers 11, the user can freely set a sorting condition for each stacker 11.

In addition, according to this embodiment, banknote detailed information of banknotes registered in the database 33 is managed by each sorting condition corresponding to the stacker 11 as a registration subject. Thus, the user can search the banknote detailed information registered in the database 33 by each sorting condition.

In addition, according to this embodiment, a serial number of a banknote, which is identified by the serial number identifying unit 37A, is included in banknote detailed information and is registered in the database 33. Thus, the banknote detailed information including the serial number of the banknote can be managed, whereby it is possible to cope with a counterfeit note, for example.

In addition, according to this embodiment, a banknote image of a banknote, which is obtained by the imaging unit 20, is included in banknote detailed information and is registered in the database 33. Thus, the banknote detailed information including the banknote image of the banknote can be managed, whereby it is possible to cope with a counterfeit note, for example.

In addition, according to this embodiment, a denomination of a banknote, which is recognized of the denomination recognition unit 21A, is included in banknote detailed information and is registered in the database 33. Thus, the banknote detailed information including the denomination of the banknote can be managed.

In addition, according to this embodiment, a recognition result of a banknote of the fitness recognition unit 21B is included in banknote detailed information and is registered in the database 33. Thus, the banknote detailed information including the recognition result of the fitness recognition unit 21B can be managed.

In addition, according to this embodiment, for example, when a client comes to a financial institute and points out that the banknote, which was dispensed from the ATM of this financial institution, is a counterfeit note, a serial number of this banknote, which is as a search condition, is searched from banknote detailed information registered in the database 33, and the search result is displayed on the display screen of the display unit 31. When the serial number is registered, the assertion of the client is accepted. On the other hand, when the serial number is not registered, it is possible to claim that this banknote has not been dispensed from the ATM of this financial institute.

In addition, according to this embodiment, for example, when an unfit note is dispensed from the financial institute to a superordinate bank, the banknote detailed information of this unfit note is registered in the database 33. In this case, when the superordinate bank points out that the dispensed banknote is a counterfeit note, a serial number of this banknote, which is a search condition, is searched from banknote detailed information registered in the database 33, and the search result is displayed on the display screen of the display unit 31. When the serial number is registered, the assertion of the superordinate bank is accepted. On the other hand, when the serial number is not registered, it is possible to claim that this banknote has not been dispensed from this financial institute.

In the above embodiment, banknote information of a banknote that is stacked in the stacker 11, a DB registration of which is set to be necessary by the banknote handling apparatus 2, is transmitted to the banknote management apparatus 3, and banknote information of a banknote that is stacked in the stacker 11, a DB registration of which is set to be unnecessary, is not transmitted to the banknote management apparatus 3. However, even banknote information of a banknote that is stacked in the stacker, a DB registration of which is set to be unnecessary, may be also transmitted to the banknote management apparatus 3. In this case, even when the banknote management apparatus 3 receives banknote information which is not necessary to be registered in the database, the banknote management apparatus 3 inhibits the registration of the banknote detailed information relating to the banknote information in the database 33.

In addition, in the above embodiment, banknote information of a banknote that is stacked in the stacker 11, a DB registration of which is set to be necessary, is obtained from the banknote handling apparatus 2, and a serial number of the banknote is identified based on the banknote image included in the banknote information. However, since banknote information of a banknote that is stacked in the stacker 11, a DB registration of which is set to be unnecessary, cannot be obtained from the banknote handling apparatus 2, the serial number of the banknote cannot be identified. However, it goes without saying that, even banknote information of a banknote that is stacked in the stacker 11, a DB registration of which is set to be unnecessary by the banknote management apparatus 3, can be obtained from the banknote handling apparatus 2, and the obtained serial number of the banknote can be identified.

In addition, in the above embodiment, the serial number identifying unit 37A is provided on the banknote management apparatus 3. However, the recorded number identifying unit 37A may be provided on the banknote handling apparatus 2. In this case, a load of the banknote management apparatus 3 can be remarkably reduced.

In addition, in the above embodiment, the sorting conditions and the DB registration necessities for the respective stackers 11 are set by operating the banknote management apparatus 3. However, the sorting conditions and the DB registration necessities for the respective stackers 11 may be set by operating the banknote handling apparatus 2.

In addition, in the above embodiment, all the banknote information is registered in the database 33. However, only a serial number of a banknote, among the banknote detailed information, may be registered.

The present embodiment has been described as above, but the technical scope of the present invention is not limited by the embodiment. Of course, various embodiments are possible without departing from the technical scope recited in the claims. Further, the effects described in the embodiment are not limited thereto.

Out of the respective processes described in this embodiment, a part of or all of the processes which are described as the automatic processes may be manually performed. Alternatively, a part of or all of the processes which are described as the manual processes may be automatically performed by a known method. Moreover, unless otherwise specified, the process procedure, the control procedure, the concrete names, and the information including various data and parameters, may be optionally changed.

Further, the respective constituent elements of the respective apparatuses are functionally and conceptually illustrated, and it is not necessary that the elements are physically constituted as illustrated. Concrete structures of the respective apparatuses are not limited to the illustrated examples.

Furthermore, all or an optional part of the respective process functions performed by the respective apparatuses may be realized by a CPU (Central Processing Unit) (or a microcomputer such as an MPU (Micro Controller Unit) or an MCU (Micro Controller Unit)), by a program analyzed and executed by the CPU (or a microcomputer such as an MPU or an MCU), or by a hardware by a wired logic.

The invention claimed is:

1. A paper sheet management system comprising:

a paper sheet handling unit including a plurality of stacking units for stacking paper sheets and a reject unit for stacking rejected paper sheets that do not fall under sorting conditions of the stacking units, the paper sheet handling unit sorting the paper sheets based on sorting conditions for sorting the paper sheets, the sorting conditions being set for the respective stacking units, and the paper sheet handling unit sequentially stacking the sorted paper sheets in the stacking units corresponding to the sorting conditions;

a first input unit configured to input information for specifying a stacking unit as a registration subject among the plurality of stacking units, the registration subject being set to be necessary in order to register paper sheet detailed information of each paper sheet that is stacked in the stacking unit specified as the registration subject;

a recognition unit configured to obtain the paper sheet detailed information of a paper sheet that is stacked in the stacking unit input as the registration subject by the first input unit; and a control unit configured to register, in a storage unit, the paper sheet detailed information obtained by the recognition unit if the paper sheet is transmitted to the stacking unit specified as the registration subject, and configured not to register the paper sheet detailed information in the storage unit if the paper sheet is transmitted to the stacking unit that is not specified as the registration subject.

2. The paper sheet management system according to claim 1, comprising a second input unit configured to input information for setting the sorting conditions for sorting the paper sheets, for the respective stacking units.

3. The paper sheet management system according to claim 2, wherein the control unit is configured to manage the paper sheet detailed information registered in the storage unit for each sorting condition corresponding to the stacking unit as the registration subject.

4. The paper sheet management system according to claim 1, wherein the paper sheet detailed information includes recognition information that uniquely specifies one of the paper sheets.

5. The paper sheet management system according to claim 1, wherein the paper sheet detailed information includes a paper sheet image.

6. The paper sheet management system according to claim 1, wherein the paper sheet detailed information includes a type of the paper sheet.

7. The paper sheet management system according to claim 1, wherein the paper sheet detailed information includes information on an unfit note or a fit note.

8. A paper sheet management system comprising:

a paper sheet handling unit including a plurality of stacking units for stacking paper sheets and a reject unit for stacking rejected paper sheets that do not fall under sorting conditions of the stacking units, the paper sheet handling unit sorting the paper sheets based on sorting conditions for sorting the paper sheets, the sorting conditions being set for the respective stacking units, and the paper sheet handling unit sequentially stacking the sorted paper sheets in the stacking units corresponding to the sorting conditions;

an input unit configured to input information for specifying a stacking unit as a registration subject among the plurality of stacking units, the registration subject being set to be necessary in order to register paper sheet detailed information of each paper sheet that is stacked in the stacking unit specified as the registration subject;

a recognition unit configured to obtain the paper sheet detailed information of paper sheets stacked in the stacking units; and a control unit configured to register, in a storage unit, the paper sheet detailed information of a paper sheet that is stacked in the stacking unit input as the registration subject by the input unit, among the paper sheet detailed information obtained by the recognition unit if the paper sheet is transmitted to the stacking unit specified as the registration subject, and configured not to register the paper sheet detailed information in the storage unit if the paper sheet is transmitted to the stacking unit that is not specified as the registration subject.

9. A paper sheet management apparatus managing a paper sheet handling apparatus having a plurality of stacking units for stacking paper sheets and a reject unit for stacking rejected paper sheets that do not fall under sorting conditions of the stacking units, the paper sheet handling apparatus sorting the paper sheets based on sorting conditions for sorting the paper sheets, the sorting conditions being set for the respective stacking units, and to sequentially stack the sorted paper sheets in the stacking units corresponding to the sorting conditions, the paper sheet management apparatus comprising:

an input unit configured to input information for specifying a stacking unit as a registration subject among the plurality of stacking units, the registration subject being set to be necessary in order to register paper sheet detailed information of each paper sheet that is stacked in the stacking unit specified as the registration subject;

a recognition unit configured to obtain the paper sheet detailed information of a paper sheet that is stacked in the stacking unit input as the registration subject by the input unit; and a control unit configured to register, in a storage unit, the paper sheet detailed information obtained by the recognition unit if the paper sheet is transmitted to the stacking unit specified as the registration subject, and configured not to register the paper sheet detailed information in the storage unit if the paper sheet is transmitted to the stacking unit that is not specified as the registration subject.

10. A paper sheet management method for managing a paper sheet handling apparatus having a plurality of stacking units for stacking paper sheets and a reject unit for stacking rejected paper sheets that do not fall under sorting conditions of the stacking units, the paper sheet handling apparatus being configured to sort the paper sheets based on sorting conditions for sorting the paper sheet, the sorting conditions being set for the respective stacking units, and to sequentially stack the sorted paper sheets in the stacking units corresponding to the sorting conditions, the paper sheet management method comprising:

specifying a stacking unit among the plurality of stacking units, as a registration subject, the registration subject being set to be necessary in order to register paper sheet detailed information of each paper sheet that is stacked in the stacking unit specified as the registration subject;

obtaining the paper sheet detailed information of a paper sheet that is stacked in the stacking unit specified as the registration subject in the obtaining, if the paper sheet is transmitted to the stacking unit specified as the registration subject; and controlling to register the paper sheet detailed information obtained in the obtaining in a storage unit, or controlling not to register the paper sheet detailed information in the storage unit if the paper sheet is transmitted to the stacking unit which is not specified as the registration subject.

11. A non-transitory computer readable medium storing a paper sheet management program, the program for managing a paper sheet handling apparatus having a plurality of stacking units for stacking paper sheets and a reject unit for stacking rejected paper sheets that do not fall under sorting conditions of the stacking units, the paper sheet handling apparatus being configured to sort the paper sheets based on sorting conditions for sorting the paper sheets, the sorting conditions being set for the respective stacking units, and to sequentially stack the sorted paper sheets in the stacking units corresponding to the sorting conditions, the paper sheet management program including:

a registration subject specifying process in which a stacking unit as a registration subject is specified among the plurality of stacking units, the registration subject being set to be necessary in order to register paper sheet detailed information of each paper sheet that is stacked in the stacking unit specified as the registration subject;

a paper sheet detailed information obtaining process in which the paper sheet detailed information of a paper sheet that is stacked in the stacking unit specified as the registration subject in the registration subject specifying process is obtained if the paper sheet is transmitted to the stacking unit specified as the registration subject; and a control process in which the paper sheet detailed information obtained in the paper sheet detailed information obtaining process is stored in a storage unit and in which the paper sheet detailed information is not stored in the storage unit if the paper sheet is transmitted to the stacking unit that is not specified as the registration subject.

* * * * *